United States Patent [19]

Boccaletti

[11] Patent Number: 4,516,503

[45] Date of Patent: May 14, 1985

[54] MACHINE FOR REPLACING RAILWAY SWITCHES AND TRACKS

[75] Inventor: Pietro Boccaletti, Reggio Emilia, Italy

[73] Assignee: AMECA S.r.l., Cavriago, Italy

[21] Appl. No.: 379,357

[22] Filed: May 18, 1982

[30] Foreign Application Priority Data

May 22, 1981 [IT] Italy ..... 46846 A/81

[51] Int. Cl.[3] ..... E01B 29/02

[52] U.S. Cl. ..... 104/3; 104/2; 414/460

[58] Field of Search ..... 104/2, 3, 7 R, 7 B; 414/459, 460

[56] References Cited

U.S. PATENT DOCUMENTS

| | | | |
|---|---|---|---|
| 4,143,974 | 8/1964 | Oville | 104/7 R X |
| 4,240,354 | 12/1980 | Newman | 105/215 C |
| 4,266,904 | 5/1981 | Fadness | 414/460 |
| 4,270,456 | 6/1981 | Theurer et al. | 104/3 |

FOREIGN PATENT DOCUMENTS

| | | | |
|---|---|---|---|
| 2309930 | 8/1974 | Fed. Rep. of Germany | 104/3 |
| 1355556 | 2/1964 | France | 104/7 R |
| 460348 | 3/1975 | U.S.S.R. | 104/7 R |

*Primary Examiner*—Randolph Reese

*Attorney, Agent, or Firm*—Brisebois & Kruger

[57] ABSTRACT

A machine to operate with at least one similar machine along a railway line to remove and install railway track portions and switches, has a portal structure extending transversely and straddling the railway line, and has telescopic uprights connected respectively to different telescopic cross-members, so that the uprights can be moved sideways independently of each other to a width sufficient to straddle a switch. At the base of each upright is a crawler track to run on the ballast at the sides of the railway line or switch. Four flanged wheels are mounted on the telescopic columns on the cross-members to move downwardly and run along the rails of the railway line. Below each cross-member are two pivotal hooks to grip the railway track portions and switches.

5 Claims, 8 Drawing Figures

MACHINE FOR REPLACING RAILWAY SWITCHES AND TRACKS

This invention relates generally to railways and tracks, and more particularly it relates to the maintenance of railway lines, i.e. to the replacement of railway switches and track portions.

BACKGROUND OF THE INVENTION

Railway lines are known to be formed from a plurality of consecutive track portions of considerable length, along which suitable railway switches, commonly known as points, are disposed in order to connect together two or more separate pairs of rails.

The maintenance of railway lines is also known to comprise the replacement of damaged or excessively worn track portions and switches.

The switches and track portions are replaced by withdrawing the complete element to be replaced, and installing a corresponding new element.

It is apparent that the complexity of such operations requires considerable use of labour and equipment, together with extremely long replacement times, resulting in very high costs.

In order to carry out the aforesaid operations, large machines have been proposed having a length practically equal to the length of the railway line elements, their use in this field being however limited by the drawbacks briefly described hereinafter.

A first drawback of the known machines is that they are hardly suitable for handling elements of different configurations and sizes such as railway track portions and complete switches, these latter having very large overall widths which differ one from the other.

Besides being bulky and of poor versatility, known machines are excessively complicated, heavy and costly.

SUMMARY OF THE INVENTION

The main object of the present invention is to provide a machine for replacing railway switches and track portions, which is extremely versatile, being able to easily handle the switches and track portions, and is capable of moving both on railway lines and along their ballast, while at the same time being of simple, rational and extremely compact structural design.

According to the invention, the proposed machine is designed to work with at least one other like machine, and is configured as a portal of variable width and height, and arranged to straddle a railway line.

According to the invention, each portal or operational unit comprises two lateral crawler tracks of adjustable distance apart, which are designed to rest and run along the side of a railway line and are connected to a platform of the unit so they can be lifted and lowered.

Between these two crawler tracks, the platform of each operational unit comprises four telescopic columns which are provided with flanged wheels designed to run on a railway line to move the machine to the replacement site.

The invention is completed by providing, between the four flanged wheels of each operational unit, two laterally pivotal profiled lifting and transportation hooks which can rock in a vertical plane lying transversely to the crawler tracks in order to hook onto the rails of a switch or of a railway track portion.

The constructional characteristics and merits of the invention will be more apparent from the detailed description given hereinafter with reference to the figures of the accompanying drawings which illustrate a particular preferred embodiment by way of non-limiting example only.

It must firstly be explained that the machine according to the invention is designed to work with at least one other similar machine, but three or more machines can be simultaneously used depending on the overall length of the railway switch or track portion to be removed or installed.

Figure 1:
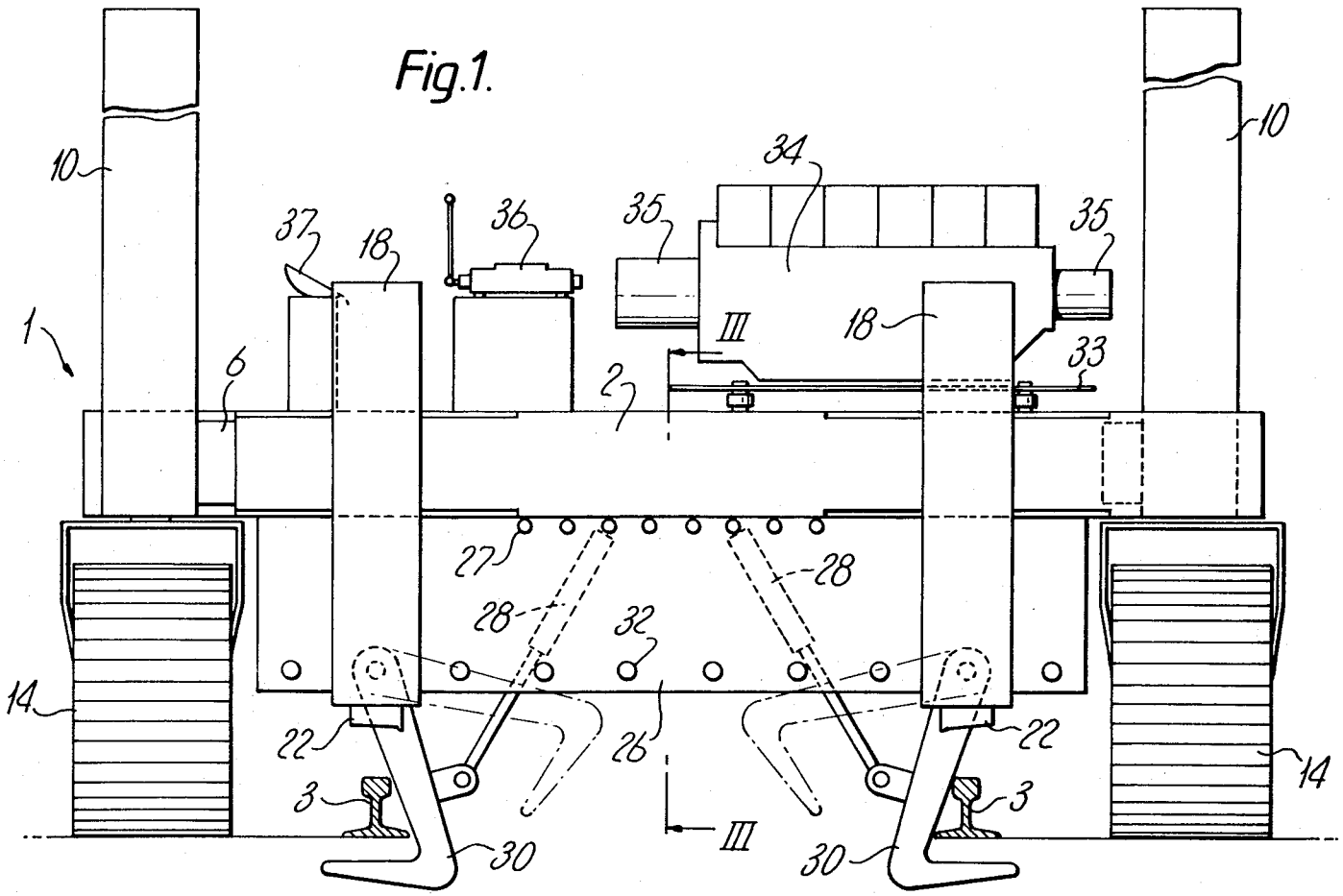
FIG. 1 is a front view of the machine according to the invention.
Figure 2:
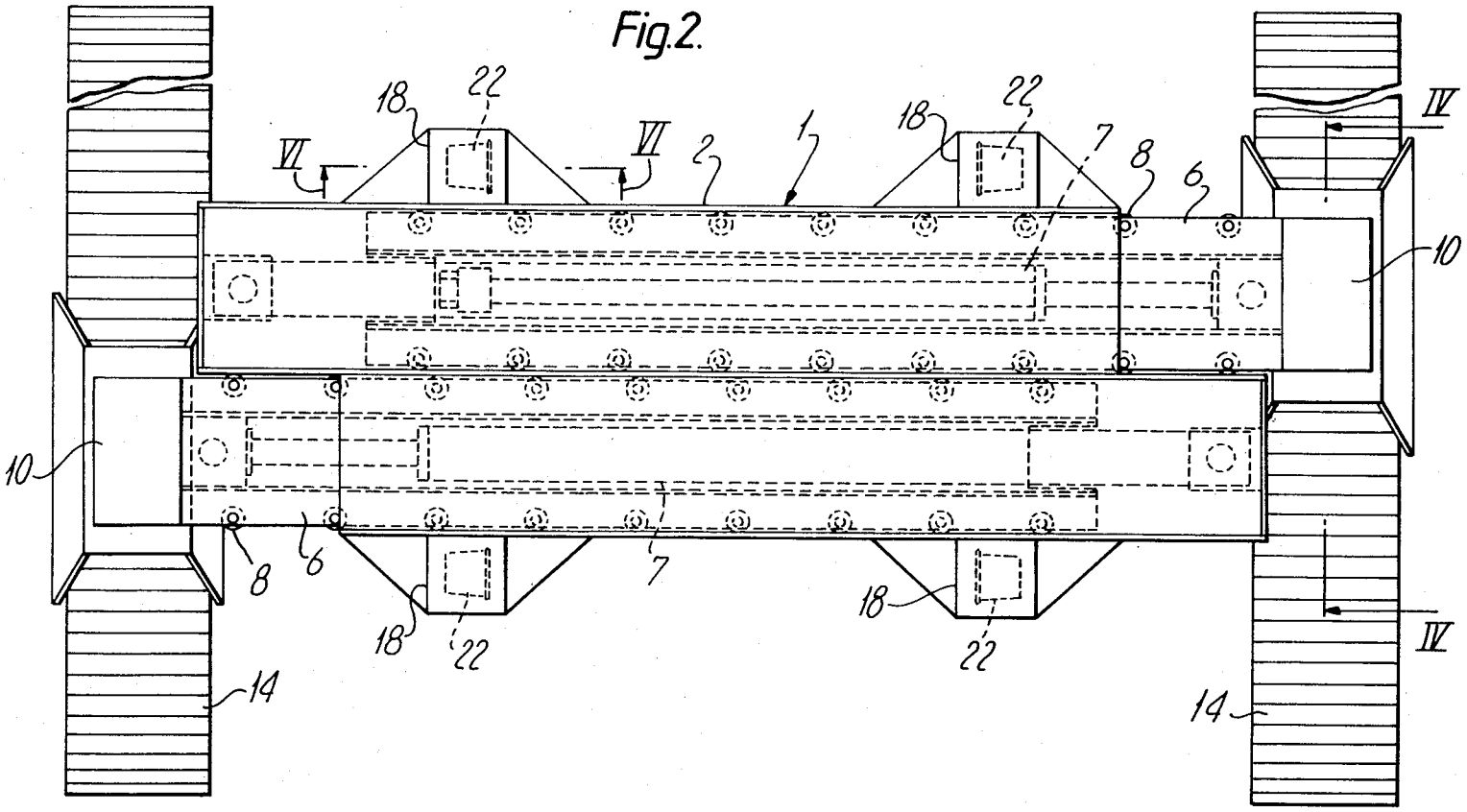
FIG. 2 is a plan view of the machine of FIG. 1.
Figure 3:
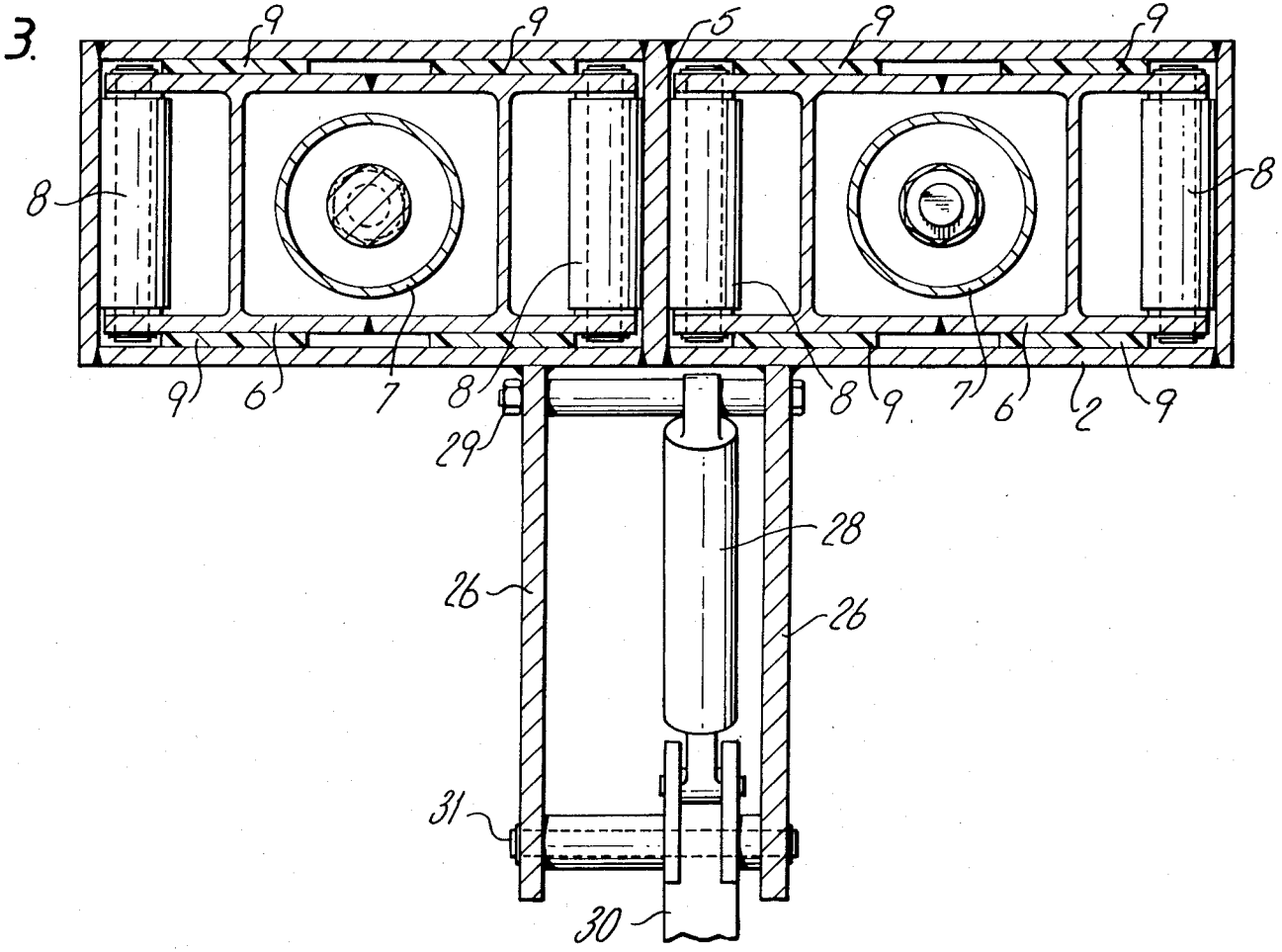
FIG. 3 is a section on the line III—III of FIG. 1.
Figure 8:
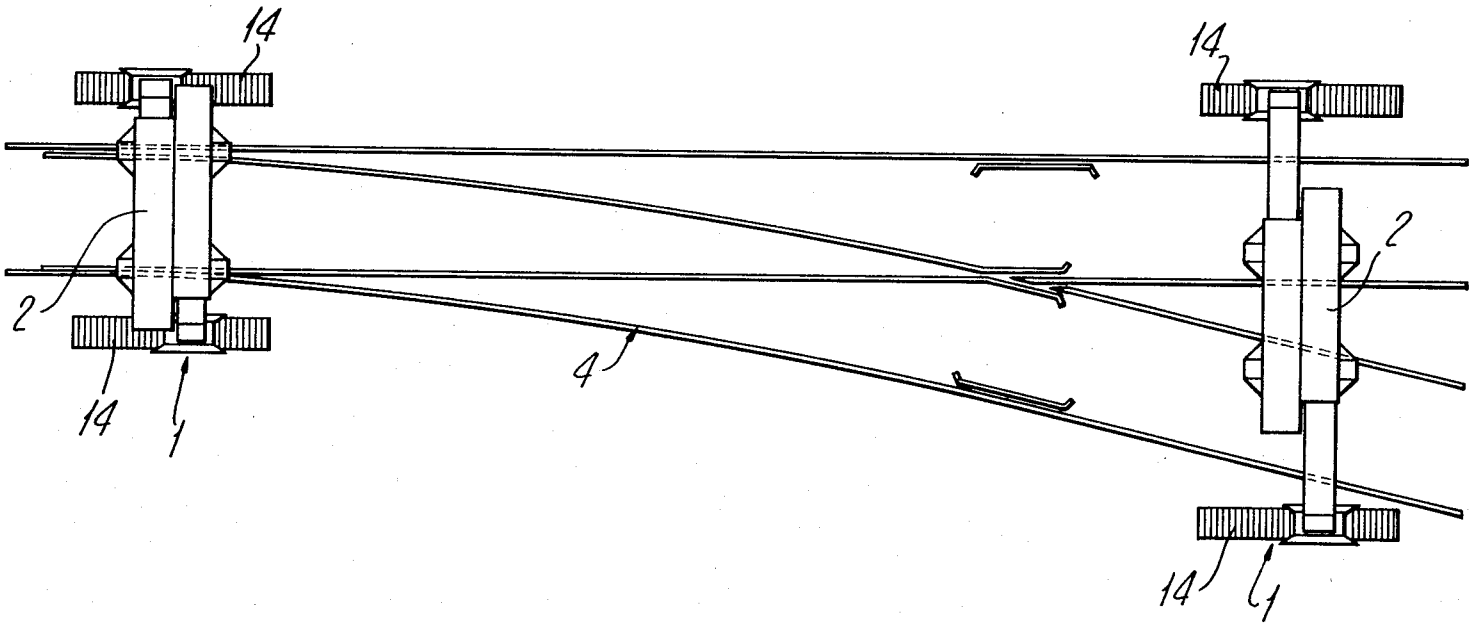
FIG. 8 is a diagrammatic plan view of a railway switch, straddled by the machine.

Referring to the drawings in particular FIGS. 1, 2 and 3, it can be seen that the machine 1 comprises a rectangular platform, of elongated shape when viewed in plan, and extends transversely to a railway track portion 3 (FIG. 1) or a switch 4 (FIG. 8).

The platform 2 is divided by a central partition 5 into two longitudinal chambers of rectangular cross-section, in which two horizontal beams 6 are slidably mounted (FIGS. 2 and 3).

Each horizontal beam is formed from two robust side-by-side I sections, of which the adjacent flanges are welded together to define a housing for a double acting hydraulic cylinder-piston unit 7.

Orthogonally to the outer flanges of each I section of each beam 6, there is rotatably mounted a set of equidistant idle rollers 8 which contact the inner face of the corresponding vertical wall of the containing chamber for the beam 6.

In addition, slide pads 9 for the beam 6 are disposed on the inner faces of the horizontal walls of the containing chamber.

As can be clearly seen in FIG. 2, the rod ends of the two cylinder-piston units 7 extend in opposite directions, and their bodies are hinged or pinned in proximity to the closed ends of the two containing chambers for the beams 6.

The outer end of each beam 6, to which the rod of the corresponding cylinder-piston unit 7 is hinged or pinned, is fixed to the base of a box upright 10 which extends above the platform 2.

Figure 4:
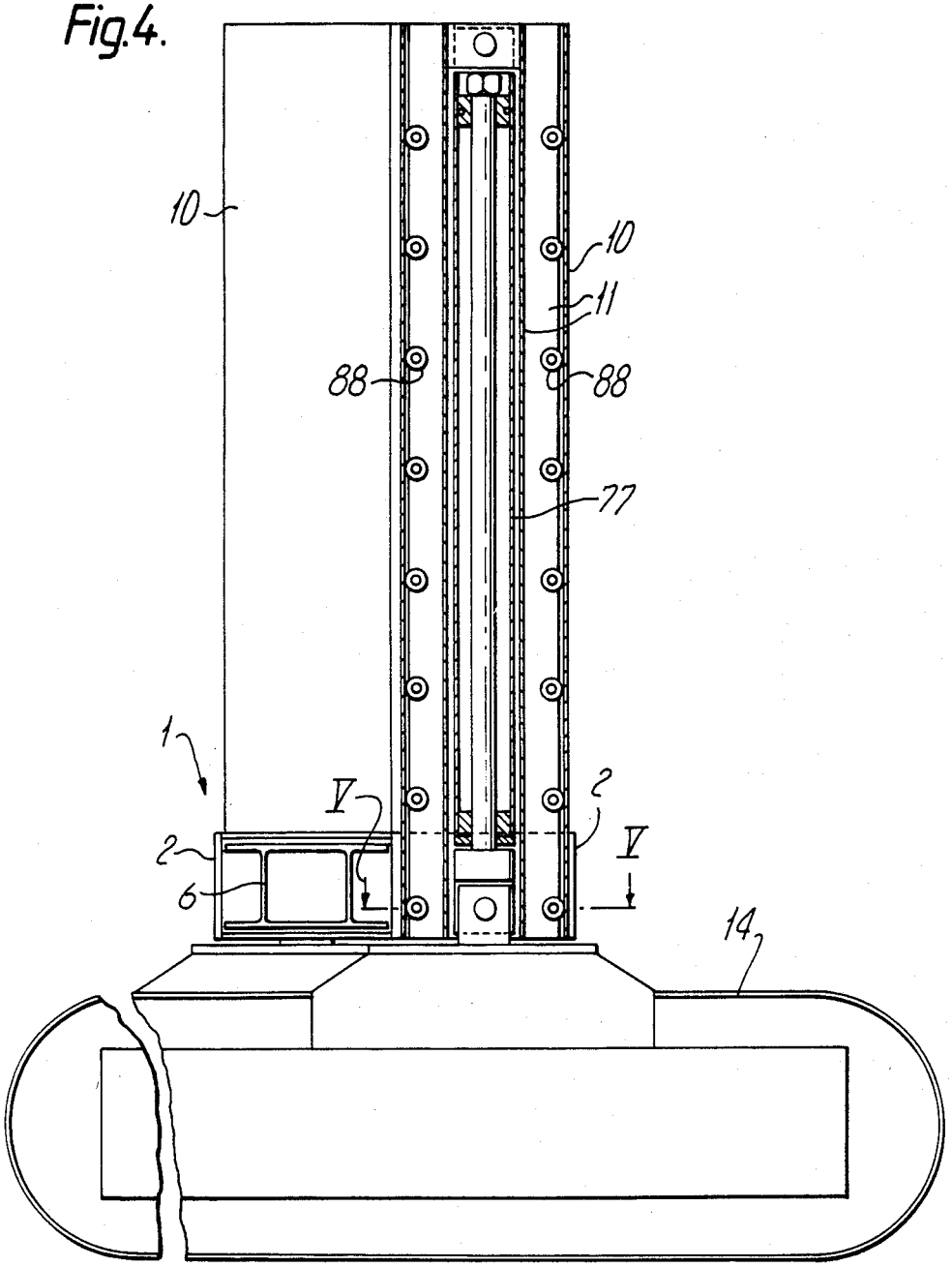
FIG. 4 is a section on the line IV—IV of FIG. 2.
Figure 5:
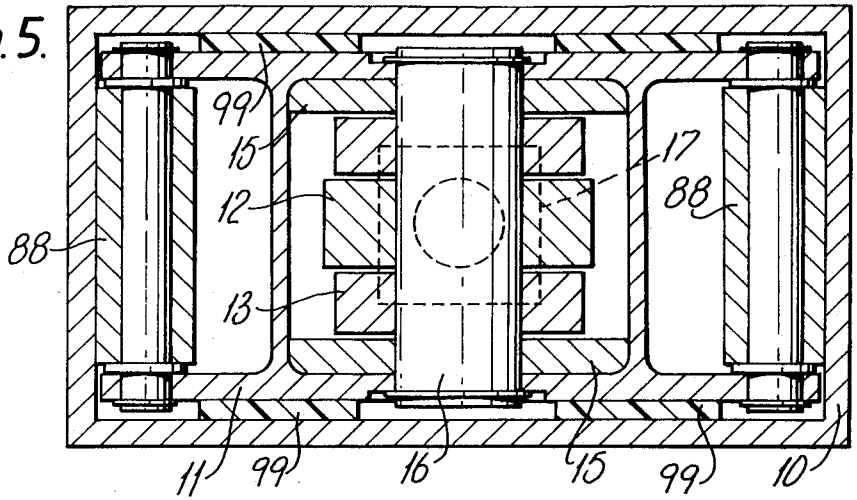
FIG. 5 is a section on the line V—V of FIG. 4.

As is more apparent from FIGS. 4 and 5, the upright 10 houses a slider 11 of a construction like the previously described horizontal beams 6.

In this respect, each slider 11 is composed of two robust side-by-side I sections welded together and guided within their box upright by respective idle rollers 88 and slide pads 99.

In the central chamber of the slider 11 there is a double acting hydraulic cylinder-piston unit 77, the body of which is pinned to the top of the upright 10.

The rod end of the cylinder piston unit 77 comprises a plate 12 disposed transversely to the platform 2 and inserted into a slot in a socket 13 of rectangular cross-section branching from the casing of a crawler track 14.

In addition, parallel to the plate 12 inside the central chamber of the slider 11 there are provided two plates 15, the purpose of which is to ensure correct positioning of the socket 13.

The elements 11, 15, 13 and 12 are connected together by a transverse pin 16 (FIG. 5).

The crawler tracks 14 are each provided with an independent drive constituted by a suitable hydraulic motor, and because their distance apart is adjustable they can straddle a railway track portion 3 or switch 4 in order to travel along the respective ballast portions.

To each longitudinal edge of the box platform 2 there are fixed two telescopic columns which are disposed symmetrical about the transverse plane of symmetry through the platform (FIGS. 1 and 2).

These telescopic columns, which extend above and below the platform 2, each consist of an outer hollow member 18 of rectangular cross-section which is rigid with the platform and in which there is slidably mounted an inner hollow member 19, which is also of rectangular cross-section (FIGS. 6 and 7) and is guided by suitable slide pads 20 rigid with the outer hollow member.

Inside the inner hollow member 19 there is fitted a double acting hydraulic cylinder-piston unit 21, of which the body is hinged or pinned to the top of the fixed outer member 18 of the corresponding column, while its rod is hinged or pinned to the lower end part of the movable inner member 19 of the column.

On the lower end of the inner hollow member 19 there is provided a flanged wheel 22, which in the illustrated example is shown to be an idle wheel, but which according to the invention can also be provided with an independent drive such as a hydraulic motor.

Figure 7:
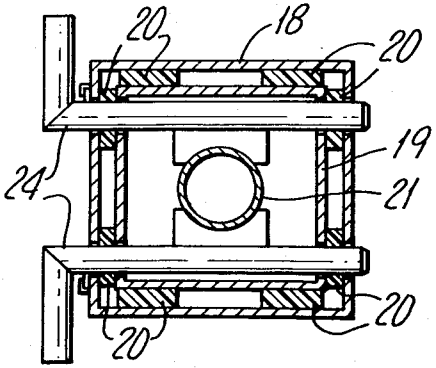
FIG. 7 is a section on the line VII—VII of FIG. 6.
Figure 6:
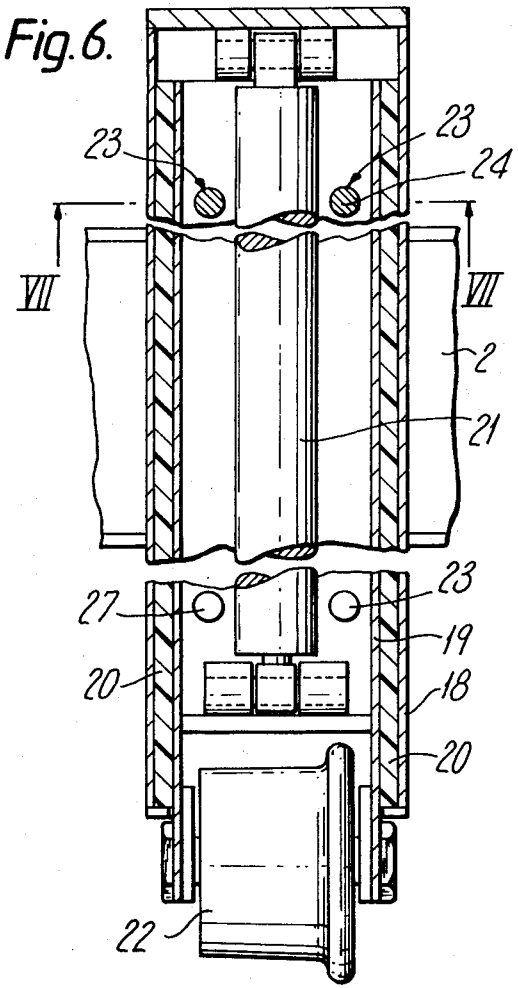
FIG. 6 is a section on the line VI—VI of FIG. 2.

From FIGS. 6 and 7 it can also be seen that the inner hollow member 19 is provided with four through bores 23, near its upper end, and near its lower end.

These two groups of four through bores move into alignment, when the inner hollow member 19 is completely extended or completely retracted, with a corresponding group of four through bores provided in the lower part of the outer hollow member 18.

In the two opposing operational positions, the two concentric hollow members 18 and 19 can be locked axially by means of two pins 24 which are inserted through the bores and which each comprise a small anti-withdrawal appendage for insertion into a suitable seat in the outer hollow member 18 (FIG. 7).

When in their completely extended position, but with the crawler tracks 14 completely retracted, the flanged wheels 22 can run on the rails of a railway line.

As can be seen more clearly from FIGS. 1 and 3, two robust orthogonal plates 26 straddling the partition 5 project from the lower wall of the platform 2.

Two facing sets of equidistant through bores 27 are provided along the upper edges of said plates 26.

These sets of bores are provided for adjusting the distance apart of two double acting hydraulic cylinder-piston units 28, of which the bodies are pivoted to the plates 26 by two extractable pins 29 provided with suitable positioning spacers.

The cylinder-piston units are inclined towards the opposite sides of the operational unit, i.e. towards the crawler tracks 14, and their rods are pivoted to the back of two profiled lifting and transportation hooks 30, of which the pointed ends face outwardly.

The upper ends of the hooks 30 are pivoted, by two extractable pins 31 provided with suitable spacers, to the upper edges of the two plates 26 where two facing sets of equidistant through bores 32 are provided.

The distance between centers of the through bores 32 is slightly greater than that of the through bores 27, and the presence of the bores 32 enables the distance between the two hooks 30 to be adjusted according to the operating position set for the cylinder-piston units 28.

As is clearly shown in FIG. 3, the two cylinder-piston units 28 and the respective hooks 30 are symmetrical about the central dividing plane through the two plates 26, so as to prevent any interference with each other.

Because of the special arrangement of the cylinder-piston units 28 and the respective hooks 30 in different planes, either both or only one of the profiled hooks 30 can be reversed if required or considered suitable, so as to be able to operate from the outside inwards.

Again with reference to the accompanying FIG. 1, it can be seen that on the box platform 2 there is provided a floor 33 carrying a motor unit 34 for driving two hydraulic pumps 35.

These latter are connected to a suitable hydraulic distributor 36, close to which there is provided a seat 37 for the operator, and to which all the aforesaid hydraulic devices lead.

As is clearly shown, the hydraulic distributor is operated manually, but the hydraulic devices can also be operated by means of a centralized electrical control system.

The operation of the invention and its extreme versatility of application are apparent from an examination of the accompanying drawings and the aforegoing description.

It need only be stated that when the machine is supported by the flanged wheels 22, the crawler tracks 14 are completely raised and can be left projecting from the platform 2 by any desired distance.

When however the crawler tracks 14 rest on the ballast to the side of a railway track portion 3 or switch 4, and the flanged wheels 22 are completely raised, the opposite action of the two cylinder-piston units 7 enables the platform to be slid laterally relative to the crawler tracks for the purpose of correctly positioning it relative to the underlying railway track portion or switch to be lifted.

As is evident from FIG. 2, the length of stroke of each cylinder 7 is only slightly less than the distance between the sides of the platform. Correspondingly, the crawler tracks 14 can be extended horizontally to fully extended positions in which the crawler tracks are spaced apart considerably more than twice the distance between the crawler tracks in their fully retracted positions. The right hand portion of FIG. 8 shows the crawler tracks 14 partly extended, to positions spaced apart approximately twice the spacing in the fully retracted positions of the crawler tracks.

Finally, the described machine satisfies the overall outline dimensions allowable for rail transport, so that it can be towed along railway lines, can be loaded and transported on railway trucks in elements, and can also be loaded and transported on flat cars.

In this respect, it can be seen from FIG. 1 that at each end of the platform 2 there is provided a notch or cavity which houses the upright 10 when the respective beam 6 is completely retracted to a position inwardly of that shown at FIG. 1.

Finally, as stated, the machine according to the invention can be provided with independent drive for its autonomous transfer from one operational zone to another, even over long distances.

The invention is not limited to the single embodiment heretofore described, and modifications and improvements can be made thereto without departing from the scope of the invention.

I claim:

1. Railway maintenance apparatus for replacing railway switches and track portions comprising, a rigid platform, four flanged wheels for engagement with tracks of a railway to transport the apparatus on the railway, means mounting two of said wheels at each side of said platform, in spaced apart relation to each other, for downward extension and upward retraction relative to said platform, motor means connected to said platform for extending and retracting said flanged wheels, first and second crawler tracks at opposite sides respectively of said platform, first means mounting said first crawler track on said platform for straight line generally horizontal movement between a retracted position adjacent one side of said platform and an extended position spaced from said one side of the platform, first cylinder means on said platform for moving said first crawler track between said extended and retracted positions, second means mounting said second crawler track on said platform for straight line generally horizontal movement between a retracted position adjacent the other side of said platform and an extended position spaced from said other side of the platform, second cylinder means on said platform for moving said second crawler track between said extended and retracted positions, said straight line movement of the first crawler track being parallel to the straight line movement of the second crawler track, means mounting said first crawler track on said first mounting means for generally vertical movement between an upper retracted position adjacent said first mounting means, and a lowered extended position spaced below said first mounting means for travel on a ballast at one side of a railway, means mounting said second crawler track on said second mounting means for generally vertical movement between an upper retracted position and a lowered extended position spaced below said second mounting means for travel on a ballast at the other side of the railway, plural hooks pivotally mounted on said platform for hooking onto a railway track portion and for lifting the track portion upon movement of said crawler tracks to said lowered extended positions, and said first and second cylinder means comprising means for shifting said platform laterally of said crawler tracks when said crawler tracks are vertically and horizontally extended for travel on the ballast, to enable accurate lateral positioning of a railway track portion supported between said crawler tracks by said hooks.

2. Apparatus according to claim 1 wherein said first and second mounting means each comprise a hollow beam slidable in a tubular support fixed to said platform, and bearing means between each beam and its tubular support.

3. Apparatus according to claim 2 wherein said first and second cylinders are respectively within said hollow beams.

4. Apparatus according to claim 3 wherein said tubular supports for said hollow beams are parallel, closely adjacent to each other, and in a common horizontal plane.

5. Apparatus according to claim 4 wherein said hollow beams and cylinders comprise means for extending said crawler tracks horizontally to extended positions at least twice the distance between the crawler tracks in the retracted positions so that the apparatus can straddle and position a switch section of the track.

* * * * *